US005794840A

United States Patent [19]

Hohl et al.

[11] Patent Number: 5,794,840

[45] Date of Patent: Aug. 18, 1998

[54] PROCESS FOR THE PRODUCTION OF PIPES BY THE UOE PROCESS

[75] Inventors: Gerold Hohl, Neuss; Gerd Vogt, Meerbusch, both of Germany

[73] Assignee: Mannesmann Aktiengesellschaft, Düsseldorf, Germany

[21] Appl. No.: 658,091

[22] Filed: Jun. 4, 1996

[30] Foreign Application Priority Data

Jun. 14, 1996 [DE] Germany ..... 195 22 790.5

[51] Int. Cl.[6] ..... B23K 31/02

[52] U.S. Cl. ..... 228/151; 228/155; 29/527.1

[58] Field of Search ..... 228/151, 155, 228/156, 158, 199; 29/33 D, 33 T, 527.1; 219/59.1; 148/519–521, 909

[56] References Cited

U.S. PATENT DOCUMENTS 2,235,243 3/1941 Adelson ..... 148/521
3,535,484 10/1970 Snow et al. ..... 148/521

FOREIGN PATENT DOCUMENTS 5279738 10/1993 Japan ..... 148/521

OTHER PUBLICATIONS

Metals Handbook Ninth Edition, vol. 1, "Steel Tubular Products", pp. 315–326, copyrite 1978.

*Primary Examiner*—Samuel M. Heinrich
*Attorney, Agent, or Firm*—Cohen, Pontani, Lieberman, Pavane

[57] ABSTRACT

A process for the producing of pipes, in particular large pipes, by the UOE process, in which the pipes are sized by cold expansion after internal and external seam welding. In order to render the strength characteristics and deformation characteristics substantially homogeneous in the circumferential direction of the pipe and in order to adjust determined characteristics in a directed manner, the pipes are conditioned by a combined application of cold expansion and cold reduction. The sequence and degree of expansion and reduction, respectively, are established depending on the required profile.

3 Claims, 6 Drawing Sheets

PROCESS FOR THE PRODUCTION OF PIPES BY THE UOE PROCESS

BACKGROUND OF THE INVENTION

1. Field of the Invention

The invention is directed to a method for the production of pipes, in particular large pipes, by the UOE process.

2. Description of the Prior Art

The process known in technical circles as the UOE process is the most frequently applied method for the production of longitudinal seam-welded large pipes (Stradtmann, Stahlrohr-Handbuch, 10th edition, Vulkan-Verlag, Essen 1996, pages 164–167). In this process, a U-shaped slit pipe is shaped in a first step from a planar sheet of metal on a press with open dies (U-press). The rounding process for forming a pipe is then effected in a second step by self-closing dies (O-press). Since the pipes in many cases do not yet meet requirements for diameter and roundness after inner and outer welding, they are sized by means of cold expansion (Expansion). At the same time, as a result of this expansion, some of the internal tensile stress which builds up during production and welding is partially removed and is even transformed into internal compressive strain along most of the circumference (company brochure by Mannesmann Groβrohr, published by MRW, D üsseldorf, 1980, pages 114–1239).

As a result of the cold expansion, pipes which are produced by the UOE process exhibit changes in strength characteristics and deformation characteristics compared to the starting sheet metal. These changes are characterized by a lack of homogeneity at the pipe circumference and by pronounced deformation anisotropy.

These changes lead to an impairment of the use characteristics and of the dependability of structural members in particular for thick-walled offshore pipes and pipes made from grades of steel with a high elastic limit/tensile strength ratio.

SUMMARY OF THE INVENTION

Accordingly, it is an object of the present invention to provide a process for producing pipes, in particular large pipes, by the UOE process, in which the strength characteristics and deformation characteristics in the circumferential direction of the pipe are rendered substantially homogeneous and in which determined characteristics can be adjusted in a directed manner.

Pursuant to this object, and others which will become apparent hereafter, one aspect of the present invention resides in conditioning the pipes by a combined application of cold expansion and cold reduction, wherein the sequence and degree of expansion and reduction, respectively, can be established depending on the required profile.

The advantages of the process according to the invention are as follows:

1. the strength characteristics and deformation characteristics in the circumferential direction of the pipe are made homogeneous, also from one pipe to the next, which results in reduced variation of individual characteristic features;

2. the pipe flow characteristics are improved in accordance with their intended use for internal and/or external pressure loading;

3. the flowability of the pipe can be adjusted in a directed manner depending on the intended use for internal or external pressure loading;

4. the collapsing pressure and the dependability of structural members of offshore pipes are increased;

5. grades of steel with a particularly high elastic limit/tensile strength ratio can be processed in an improved manner;

6. the circumferential internal stresses at the pipe circumference are made homogeneous;

7. the deformability of the pipe in the uniform elongation range is increased;

8. the dimensional stability and pipe geometry (prevention of noncircularity and peaking) is improved; and 9. the shaping forces occurring in the O-press and during cold expansion can be reduced.

The last advantage is particularly important for thick-walled pipes, since the O-press and the conventionally used mechanical expander are worked to the load limit. Since some of the required shaping overlaps with the conditioning, the loading can accordingly be reduced for the O-press as well as for the mechanical expander.

The process mentioned above can also be used for the three-roll bending process with integrated cold expansion. In this case, in contrast to the UOE process, less importance is placed on homogenization than on the adjustment of the strength characteristics and pipe geometry.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
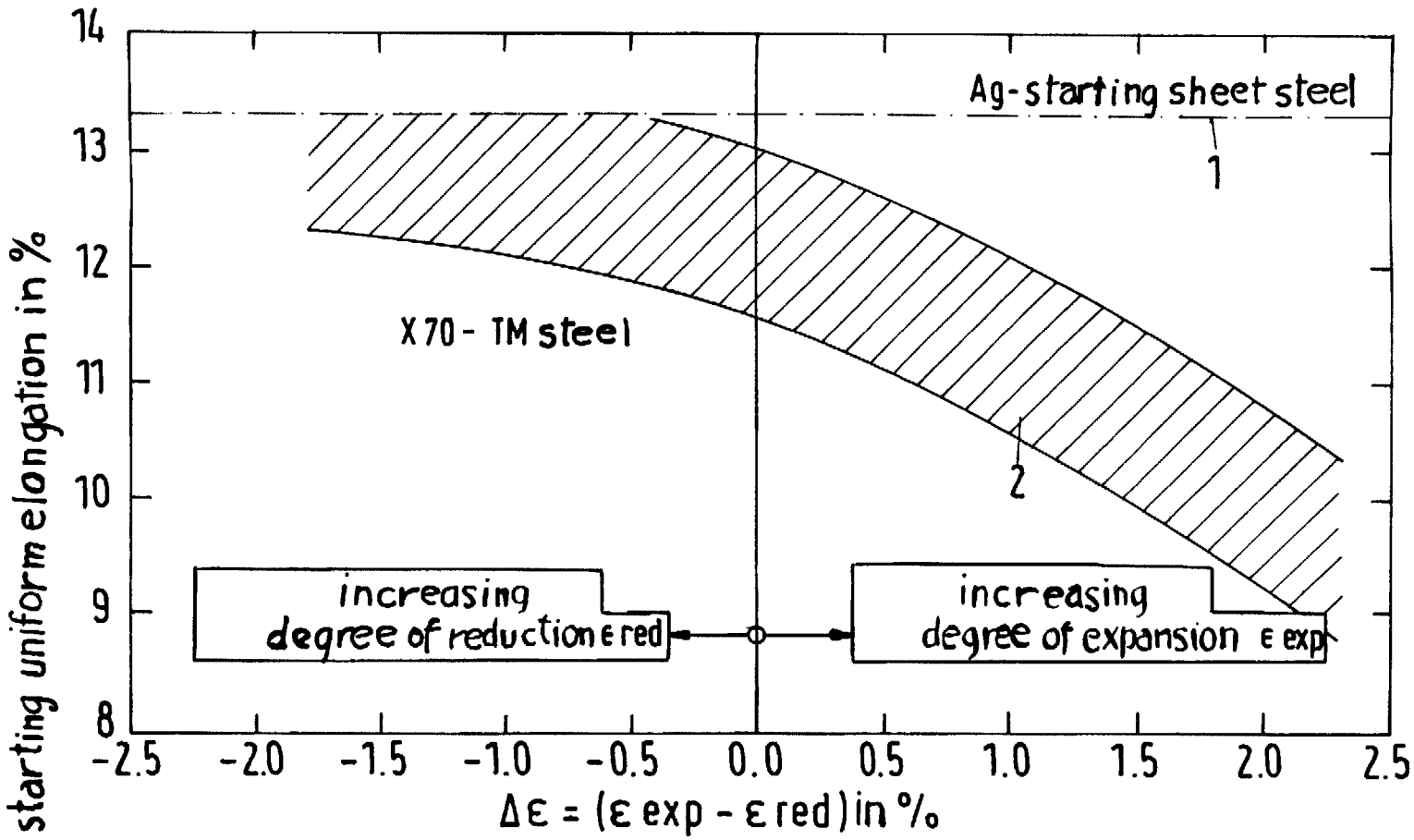
FIG. 1 is a graph of the uniform elongation in the circumferential direction of the pipe as a function of the degree of reduction and expansion.

FIG. 1 shows a graph of the uniform elongation in the circumferential direction of the pipe as a function of the degree of reduction and expansion. The uniform elongation is plotted as a percentage on the ordinate, and the degree of deformation resulting from reduction and expansion is plotted as a percentage on the abscissa. The fine dotted straight line 1 is the uniform elongation for the starting sheet metal material, e.g., for X70-TM, i.e., thermomechanically rolled steel. In this graph, the uniform elongation lies above 13%. The curved band 2 located below the line 1 shows the variation in the test values. At 0% deformation, the uniform elongation values already lie below those of the sheet steel due to the pipe production. If the pipe is considerably expanded in the course of pipe production, the uniform elongation decreases sharply as is clearly shown by the graph. On the other hand, if the pipe is reduced, the uniform elongation increases and can regain the starting value of the sheet steel as an individual value or even as a mean value depending on the degree of reduction.

Figure 2:
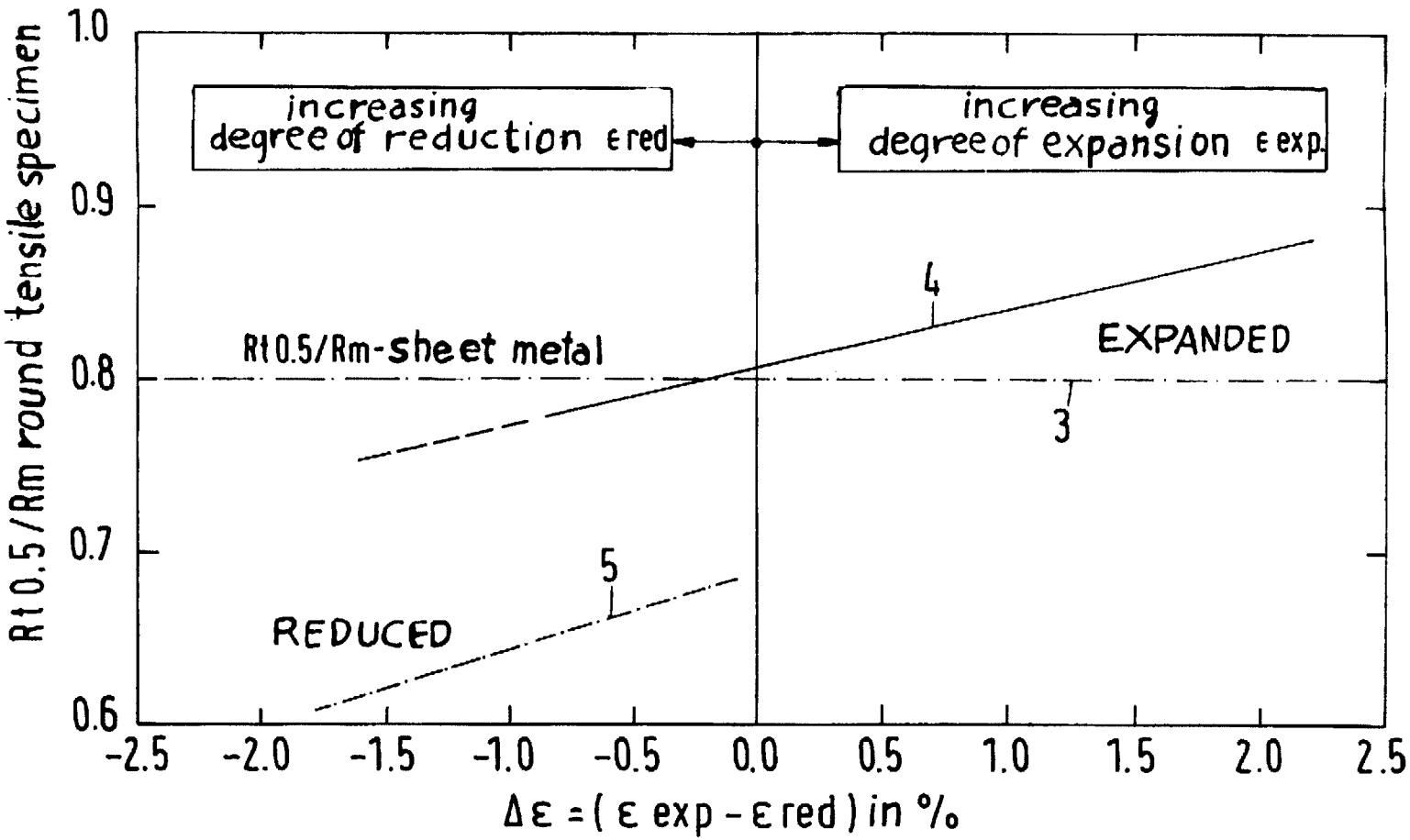
FIG. 2 is a graph of the elastic limit/tensile strength ratio in the circumferential direction of the pipe as a function of the degree of reduction and expansion.

FIG. 2 shows a graph of the elastic limit/tensile strength ratio in the circumferential direction of the pipe as a function of the degree of reduction and expansion. The elastic limit/tensile strength ratio $R_t0.5/R_m$ is plotted on the ordinate and the degree of deformation is shown as a percentage on the abscissa. The fine dotted straight line 3 is the elastic limit/tensile strength ratio for the starting sheet metal material. This ratio should be 0.8, for example. The bold solid line 4 shows the increase in the elastic limit/tensile strength ratio as the degree of expansion increases. The continuation of this line in the left half of the graph shows the decrease in the elastic limit/tensile strength ratio when expansion is increasingly superimposed on the preceding reduction. On the other hand, if a reduction of the pipe is immediately halted, this gives the dash-dot line 5. This line 5 clearly shows that the elastic limit/tensile strength ratio drops sharply compared to the initial value of the sheet metal as the result of even a small reduction.

Figure 3:
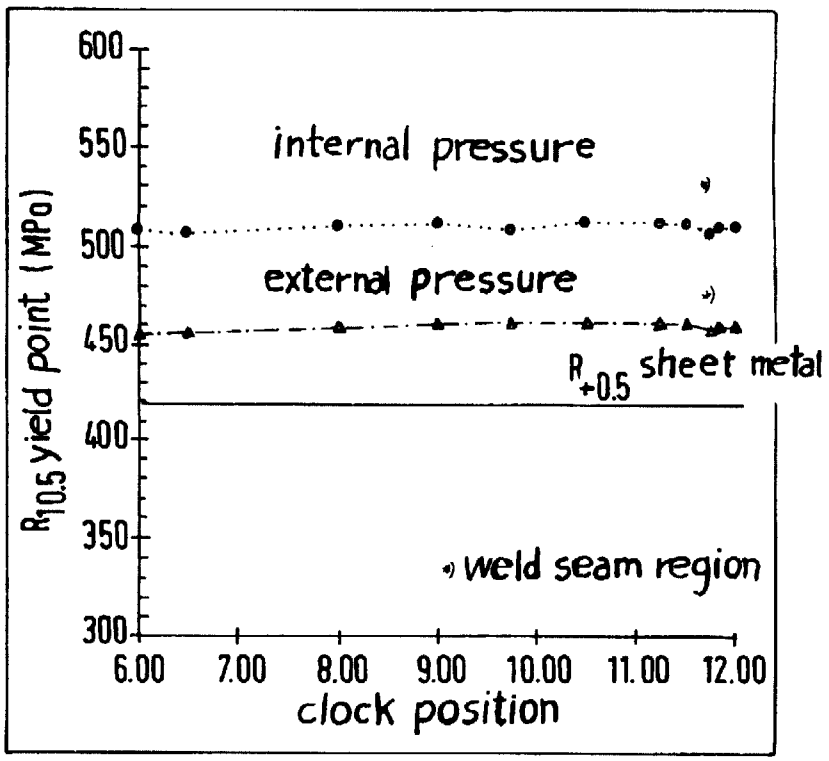
FIG. 3 is a graph of the $R_t0.5$ yield point along the circumference of the pipe as a function of internal or external pressure, where graph a) shows the prior art process and graph b) shows the process according to the invention.
Figure 3:
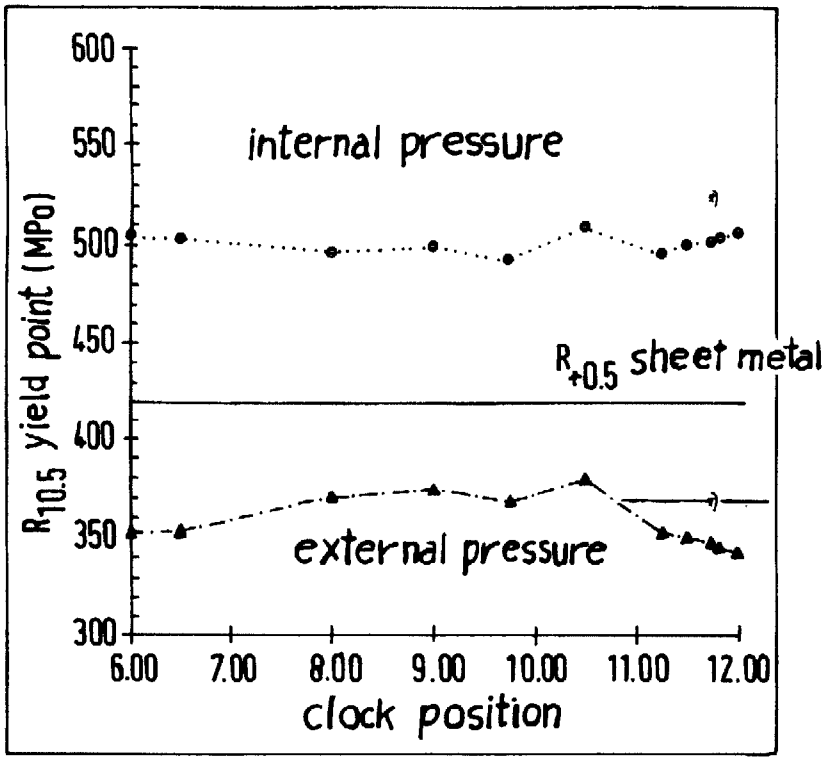
Fig.3 a) PRIOR ART

FIG. 3 shows two partial graphs illustrating the $R_t0.5$ yield point along the pipe circumference as a function of internal or external pressure. In the conventional process (graph a)), the yield point values under loading by external pressure lie considerably below those under loading by internal pressure. This means that the pipe has a low collapsing resistance. Furthermore, the curve along the pipe circumference shows that the values are not uniformly distributed. This means that influences of pipe production are still readily apparent and determine the behavior of structural members under internal or external pressure. When applying the new process according to the invention (graph b)), the values become uniform along the pipe circumference. The yield point under external pressure loading is appreciably higher so that the pipe produced in this way has a greater resistance to collapsing.

Figure 4:
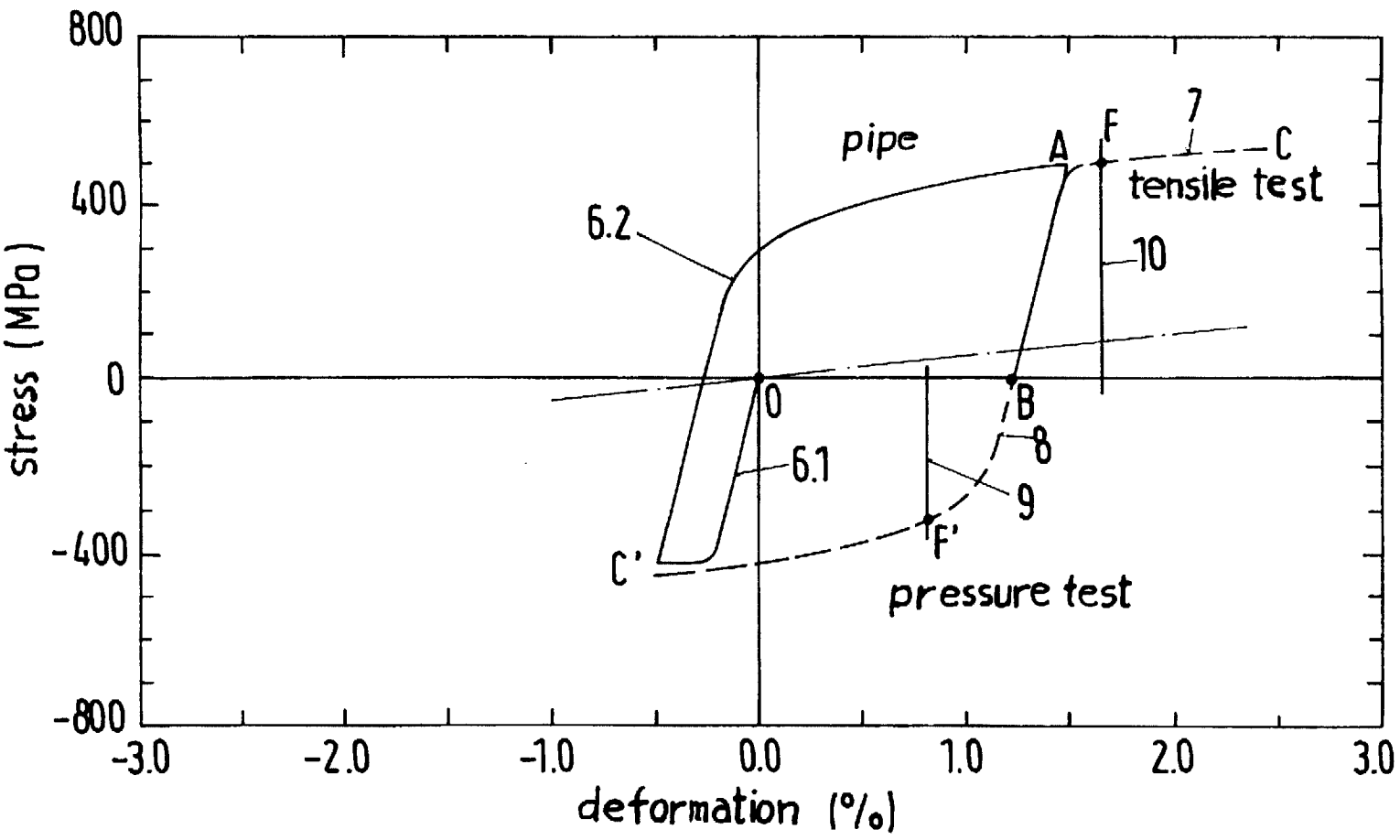
Fig. 4 PRIOR ART
FIG. 4 is a stress-strain diagram for production and testing according to the prior art process.
Figure 5:
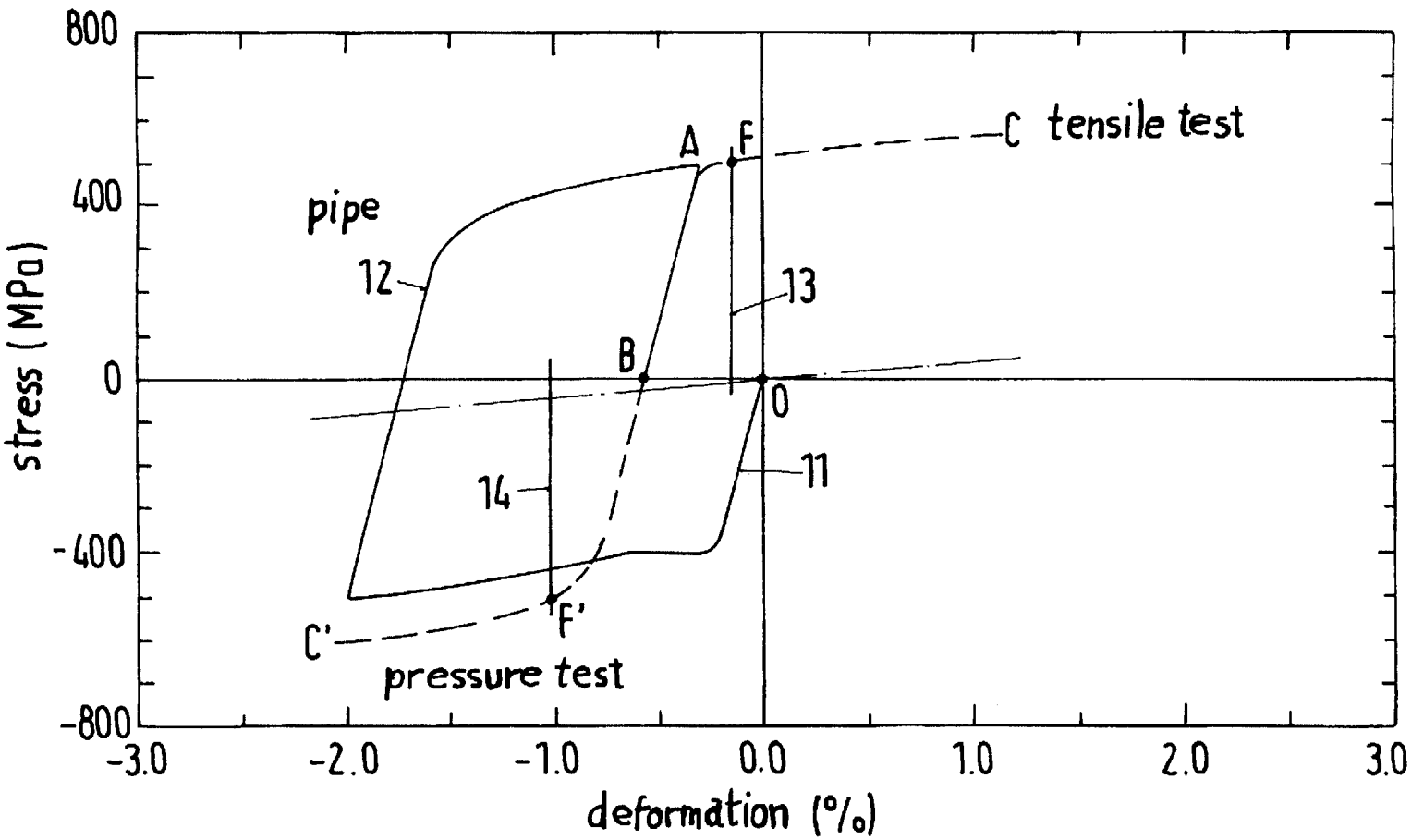
FIG. 5 is a stress-strain diagram for production and testing according to the inventive process for the production of onshore pipes.

Stress-strain diagrams are shown in FIGS. 4 and 5. The stress is plotted in megapascals on the ordinate and the percent deformation is plotted on the abscissa.

FIG. 4 shows the stress curve during the production of line pipe according to the conventional process. The solid line, proceeding from the coordinate origin zero along point A to point B, shows the change in stress during production. A certain reduction takes place in the O-press and is characterized here by curve segment 6.1. After welding, an intensive expansion is effected by means of a mechanical expander which is represented in the graph by curve 6.2 which extends to point A. After relieving, the stress drops to the value at point B. When a specimen is taken for the tensile test in the case of a pipe produced in this way, the stress/strain follows the curve segment 7 which is shown in dashes, wherein the yield point is reached at point F and another elongation limit is reached at point C. Conversely, when a pressure test is carried out instead of a tensile test, the stress/strain follows the curve 8, for example, wherein the yield point is reached at F' and another strain limit is reached at C'. However, due to the Bauschinger effect, the ordinate value F' 9 is significantly less than the value F corresponding to the ordinate 10 in the tensile test. These ratios change when applying the process according to the invention.

FIG. 5 shows the ratios in the manufacture of onshore pipes. In these pipes, a high reduction is first applied according to the invention corresponding to the solid curve 11, starting at the coordinate origin zero. Expansion is then effected corresponding to curve 12 until point A. After relieving, the stress drops to the value at point B. The tensile test gives the yield point at an ordinate value F13 which is relatively equal to that shown in FIG. 4 according to the conventional process. The decisive difference consists in the ordinate value F'14 at the reversal of deformation. This value F' is approximately equal to value F and perhaps even somewhat greater.

Figure 6:
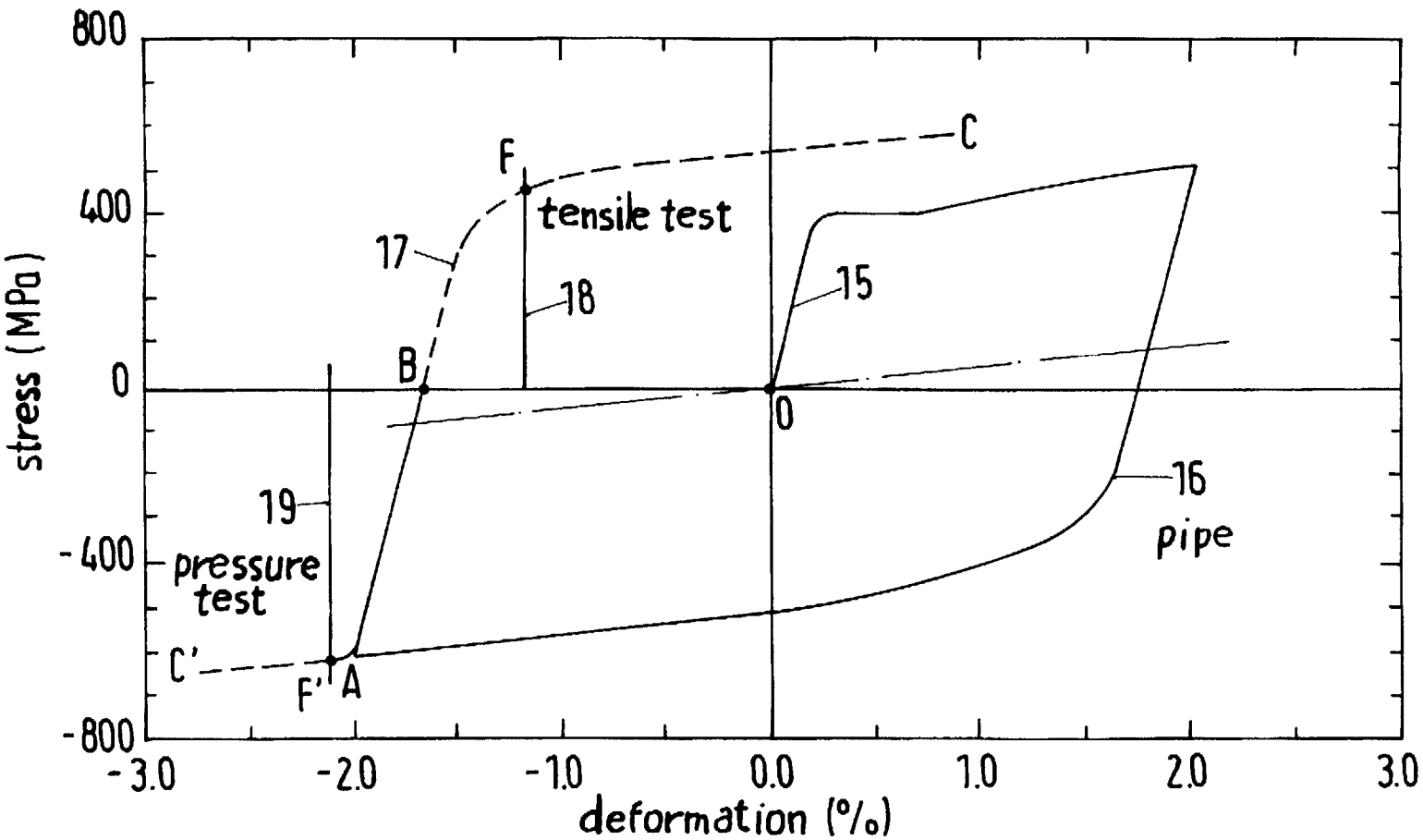
FIG. 6 is a diagram as in FIG. 5, but for the production of offshore pipes.

FIG. 6 shows the ratios in the production of offshore pipes. In this case, the pipe is first homogenized by expansion according to the invention and is then adjusted with respect to diameter and strain limit by reduction. The rise in stress is shown by the thick solid curve 15 starting at the coordinate origin O. The drop at the cessation of reduction is shown in curve 16 to point A. After relieving, the stress decreases to the value at point B. When a tensile test is carried out again, the stress increases to the ordinate value 18 at point F corresponding to the dashed line 17. This point lies somewhat below the comparable values F corresponding to FIGS. 4 and 5. The reverse, i.e., the pressure test, gives an ordinate value 19 at point F' which is considerably greater than the value determined in the tensile test.

The invention is not limited by the embodiments described above which are presented as examples only but can be modified in various ways within the scope of protection defined by the appended patent claims.

I claim:

1. A process for producing a pipe pursuant to the UOE process, comprising the steps of: shaping the pipe from a metal sheet; internally and externally welding a seam of the pipe to form a closed circumference; sizing the pipe by cold expansion after the welding step; and conditioning the pipe by cold expansion and cold reduction in a sequence and to a degree of expansion and reduction based on a requirement profile.

2. A process according to claim 1, wherein the conditioning step includes reducing the pipe up to 2% and subsequently expanding the pipe up to 4% to a reference dimension.

3. A process according to claim 1, wherein the conditioning step includes expanding the pipe up to 2% and subsequently reducing the pipe up to 4% to a reference dimension.

* * * * *